United States Patent [19]

Weber et al.

[11] 4,409,023

[45] Oct. 11, 1983

[54] PROCESS FOR DIRECTLY MAKING LIQUID PIG-IRON FROM COARSE IRON ORE

[75] Inventors: Ralph Weber, Sao Paulo, Brazil; Bernt Rollinger, Baden-Baden, Fed. Rep. of Germany; Rolf Hauk, Baden-Baden, Fed. Rep. of Germany; Michael Nagl, Baden-Baden, Fed. Rep. of Germany; Bernhard Rinner, Kehl am Rhein, Fed. Rep. of Germany

[73] Assignees: Korf-Stahl AG, Fed. Rep. of Germany; Voest-Alpine AG, Austria

[21] Appl. No.: 300,904

[22] Filed: Sep. 10, 1981

[30] Foreign Application Priority Data

Sep. 12, 1980 [DE] Fed. Rep. of Germany ..... 3034539

[51] Int. Cl.[3] ..... C21B 13/14

[52] U.S. Cl. ..... 75/38; 266/183

[58] Field of Search ..... 75/38; 266/183

[56] References Cited

U.S. PATENT DOCUMENTS

| | | | |
|---|---|---|---|
| 2,889,219 | 6/1959 | Halley | 266/183 |
| 4,235,425 | 11/1980 | Beggs et al. | 266/147 |
| 4,238,226 | 12/1980 | Sanzenbacher et al. | 75/38 |
| 4,248,626 | 2/1981 | Scarlett et al. | 75/38 |

FOREIGN PATENT DOCUMENTS

| | | | |
|---|---|---|---|
| 1502090 | 2/1978 | United Kingdom | 266/195 |

*Primary Examiner*—M. J. Andrews

[57] ABSTRACT

A process and a device are described for directly making liquid pig-iron from coarse iron ore. Hot sponge-iron particles are directly conveyed by a worm conveyor (17) through a communicating passage (19) from a direct-reduction blast-furnace shaft (2) into a smelter-gasifier (1), and a stream (24) of gas flows, after cooling to below 950° C., in counter-current to the sponge-iron particles, from the smelter-gasifier (1) to the blast-furnace shaft (2), this gas stream having a volumetric flow-rate not more than 30 percent of the total reduction-gas flow reaching the blast-furnace shaft (FIG. 1).

7 Claims, 2 Drawing Figures

1
2
3
3
4
5
6
7
7
8
9
10
10
11
12
13
14
15
16
17
17
17
18
18
19
19
21
21
22
23
24
24
24

PROCESS FOR DIRECTLY MAKING LIQUID PIG-IRON FROM COARSE IRON ORE

The invention relates to a process for directly making liquid pig-iron from coarse iron ore, in which the ore is charged as loose bulk material into a direct-reduction shaft and there reduced to sponge-iron by the action of a hot reducing gas, after which the hot sponge-iron is transferred by a discharging device directly through at least one communicating passage into a smelter-gasifier which produces, from coal and a blown-in oxygen-bearing gas, both the heat necessary for melting the sponge-iron and the reduction gas, of which a first part-stream, after cooling to the temperature specified for the reduction of the ore, and after removal of dust, is blown into the reduction zone of the reduction shaft.

A process of this kind are known from the German Offenlegungsschrift No. 28 43 303. In this known process a smelter-gasifier produces a reducing gas which leaves the smelter-gasifier at a temperature of 1200° to 1400° C. and also carries a heavy load of dust. Before this gas can be fed to the blast-furnace shaft it first has to be cleaned and cooled to a temperature suitable for the direct reduction process, which is about 800° C. If the gas were to enter the blast-furnace shaft directly at the higher temperature this would soon cause the sponge-iron particles to clot together and the heavy load of dust would fill up the spaces between the particles, making the process impossible to operate. Consequently in this known process there is no direct communication between the blast-furnace shaft and the smelter-gasifier, the hot sponge-iron being conveyed from the blast-furnace shaft to the smelter-gasifier through a lock (a lock-gate) which separates the two vessels from each other.

But locks (or lock-gates) of this kind have been found to be unreliable in operation, due to the high temperatures involved and due to the nature of the bulk material which has to pass through them. The sponge-iron particles adhere to the moving parts of the lock, spoiling the gas-tight seals. And the excessively hot reducing gas softens the sponge-iron particles so that they stick together.

The intention in the present invention, starting out from a process of the kind mentioned at the beginning, is to arrange matters so that the hot sponge-iron particles can be conveyed continuously from the blast-furnace shaft to the smelter-gasifier without the difficulties mentioned above arising. To ensure a high thermal efficiency in the entire process the sponge-iron particles, which are at a temperature just below softening point in the blast-furnace shaft, must be conveyed to the smelter-gasifier both continuously and reliably.

The problem is solved, according to the process of the invention, by cooling down a second part-stream of reduction gas flowing counter-current to the sponge-iron particles to a temperature below 950° C. and passing it through the communicating passage from the smelter-gasifier to the direct reduction shaft, the flow-resistance in the path of the second part-stream being adjusted such that the volumetric flow-rate of the second part-stream is 5 to 30 percent of the total flow of reduction gas entering the direct reduction shaft.

In the process of the present invention there are no locks (or lock-gates) for preventing the hot (1200° C.) and dirty reduction gas from the smelter-gasifier from flowing directly into the blast-furnace shaft. It has been found that it is perfectly practical to allow a small portion of the reducing gas produced in the smelter-gasifier to flow, in counter-current to the particles of sponge-iron, into the blast-furnace shaft, provided that before entering the blast-furnace shaft this small stream of reducing gas is cooled to a temperature below the softening point of the sponge-iron particles. In cooling this stream of gas it must be ensured that this does not impair the quality of the reducing gas. A particularly effective cooling method has been found to be to admix with the hot reducing gas coming directly from the smelter-gasifier a stream of reducing gas which has been cooled down to 100° C. and cleaned. When the gas reaches the discharging device the dust in the gas is largely deposited on the sponge-iron particles near the outlet of the discharging device. This deposited dust is therefore returned to the smelter-gasifier with the sponge-iron particles which are being conveyed. As already mentioned, it is necessary to ensure that the stream of uncleaned reducing gas entering the blast-furnace shaft directly from the smelter-gasifier must have a low volumetric flow-rate compared with the stream of cleaned and cooled reducing gas which is blown into the blast-furnace shaft at correct process temperature. To ensure this, the flow resistance in the path followed by the uncleaned gas coming directly from the smelter-gasifier must be much greater than the flow resistance in the path of the reducing gas which has been cleaned and cooled to the correct process temperature. The flow resistance in the first of these two paths is due essentially to the presence of the discharging device, on the one hand, and the column of loose material in the blast-furnace shaft up to the level of the gas inlet for the main blast of cleaned and cooled reducing gas. For this reason it is advisable to provide a discharging device which has a high flow-resistance for gas, and to minimize the flow-resistance in the second path by selecting suitable dust-removing and gas-cleaning devices. A particularly suitable discharging device has been found to be a paddle-worm conveyor discharging directly to a fall-pipe leading down to the smelter-gasifier. The paddle-worm conveyor provides the desired high flow-resistance to the gas passing through it, and also forms an effective dust filter. And the constant conveying of the dust mixed with the sponge-iron particles gives a good self-cleaning effect.

The invention will now be described in greater detail on the basis of the example shown in the two figures, in which.

Figure 1:
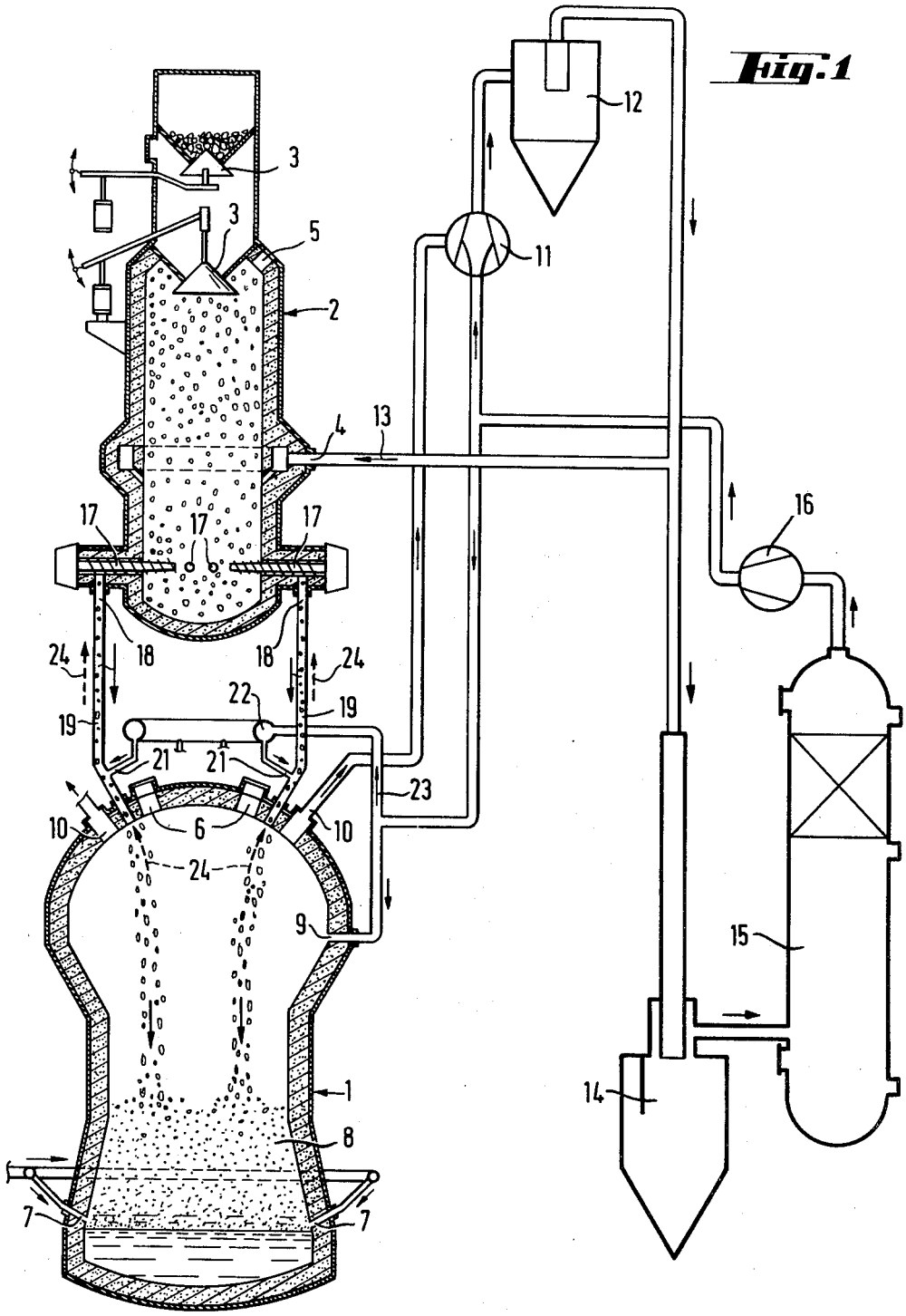
FIG. 1 represents diagramatically the process and apparatus of the invention.

The apparatus shown diagramatically in FIG. 1, for making liquid pig-iron directly from coarse iron ore, has a smelter-gasifier 1 of the kind described in the German Offenlegungsschrift No. 28 43 303. Above the smelter-gasifier 1, and suspended from a steel frame which is not shown in the drawing, there is a direct-reduction blast-furnace shaft 2, whose principle has been described, for example, in the German Offenlegungsschrift No. 29 35 707. Into the blast-furnace shaft 2 there is charged through a gas-tight double-bell valve 3 coarse iron ore which gradually sinks downwards in the blast-furnace shaft, the ore being reduced during its downward passage to sponge-iron by a blast of hot reducing gas entering through a mid-level gas inlet 4, the blast heating the ore to a temperature in the range 750° to 850° C. The spent gas leaves the blast-furnace shaft 2 through upper gas outlets 5, for re-cycling in the conventional manner through the reducing gas circuit or for utilisation in some other manner.

The hot sponge-iron produced by the reduction of the iron ore is discharged at a temperature in the range 750° to 850° C. from the lower portion of the blast-furnace shaft 2 continuously from above into the smelter-gasifier 1. In the smelter-gasifier 1 coal is charged through upper inlets 6, and oxygen-bearing gas, in particular oxygen and air, is blown in through twelve radially disposed nozzles 7, so that there is formed, in the lower portion of the smelter-gasifier 1, a fluidised bed 8 in which even the larger particles of sponge-iron sink downwards comparatively slowly. Moving downwards in the fluidised bed, the particles of sponge-iron are heated to their melting points in the lower and hotter region of the bed, forming a pool of molten iron and slag in the bottom of the smelter-gasisifer 1.

In the smelter-gasifier 1, above the fluidised bed 8 there is a stabilising chamber into which is blown, through radially disposed nozzles 9, a cooling gas comprising steam, hydrocarbons or, for example, reduction gas which has been cooled down to 50° C., for the purpose of cooling the hot reduction gases produced in the smelter-gasifier 1. The reduction gas produced in the smelter-gasifier 1 leaves through two gas outlets 10, situated above the stabilising chamber, at a temperature in the range 1200° to 1400° C. and at a pressure of about 2 bars. From here the reduction gas reaches a gas-mixer 11 where it is mixed with a cooling gas which is cool enough to bring the gas mixture down to a temperature low enough for the direct-reduction process, usually in the range 760° to 850° C. The gas-mixer 11 is constructed in such a way that a portion of the kinetic energy of the cooling gas is recovered, after the mixing process, in the form of pressure, so as to minimise the pressure drop in the path followed by the hot reduction gas. From the gas-mixer the gas reaches a cyclone-separator 12 which largely removes the entrained coke dust and ash. The gas leaving the gas-mixer 11, cleaned and cooled down to process temperature, is split into two part-streams. About 60% by volume is blown, as a first gas part-stream 13, through the mid-level gas inlet 4 into the reduction zone of the blast-furnace shaft 2, the remainder passing to an injection-spray cooler 14 and from there to a washing tower 15, for the recovery of cooling gas. The gas leaving the washing tower 15 is compressed is a compressor 16, which feeds the gas, at a temperature of about 50° C., partly to the mixer 11 for cooling the hot reduction gas leaving the smelter-gasifier 1 through the gas outlets 10, and partly in two further streams to the nozzles 9 and to a ring-manifold 22, as will be described a little later.

For removing the hot sponge-iron particles from the blast-furnace shaft 2 there are provided, symmetrically distributed radially around the middle axis of the blast-furnace shaft 2, six free-standing paddle-worm conveyors 17. The outlet 18 of each conveyor 17 is connected to a fall-pipe 19 through which the sponge-iron particles fall through the top-cover of the smelter-gasifier 1 into its interior. There are therefore six axial-symmetrically disposed fall-pipes 19 altogether. Situated as close as possible to the inlet of the smelter-gasisifer 1 there are, connected one to each of the fall-pipes 19, six nozzles 21, all connected to the ring-manifold 22 which conveys, as a third gas part-stream 23, the reduction gases, cleaned and cooled down to 50° C., delivered by the compressor 16.

In the conventional process and apparatus costly arrangements are necessary to prevent the uncleaned and excessively hot raw reduction gases delivered by the smelter-gasifier 1 from reaching, without being first processed in any way, the direct-reduction blast-furnace shaft 2. In contrast to this, in the process of the present invention only a limited stream of reduction gas is allowed to flow directly from the smelter-gasifier 1 to the blast-furnace shaft 2, the stream of gas entering the blast-furnace shaft 2 through the paddle-worm conveyor 17 and flowing counter-current to the downwards-moving hot sponge-iron. This limited stream of uncleaned reduction gases, flowing upwards through the fall-pipes 19, can conveniently be called the second gas part-stream 24. The temperature of this gas part-stream 24 is reduced soon after it enters each fall-pipe 19 by a controlled flow of cooling gas arriving through the nozzles 21 from the ring-manifold 22, so as to bring the temperature of the second gas part-stream 24 down to between 760° and 850° C. before it flows through the worm-conveyor 17 into the interior of the blast-furnace shaft 2. In adding this cooling gas, care is taken to ensure that strong turbulence occurs where the gases mix. The dust entrained with the gases rising through the fall-pipes 19 is largely deposited in the worm-conveyor 17 and is thus returned, with the downwards-moving sponge iron, to the smelter-gasifier 1.

It is important to limit the second gas part-stream 24, i.e. the stream of raw reduction gas flowing upwards directly from the smelter-gasifier 1 through the six fall-tubes 19, to not more than 30 percent by volume of the total flow of reduction gas entering the direct-reduction blast-furnace shaft 2. To obtain this low percentage the flow-resistance in the path of the second gas part-stream 24 all the way as far as the level of the mid-level gas inlet 4 must be greater than the flow-resistance in the path of the first gas part-stream 13, all the way from the gas outlet 10 to the mid-level gas inlet 4. This desired effect is conveniently obtained with the help of the paddle-worm conveyor 17, and in that flow-resistance in the path of the first gas part-stream is intentionally kept as low as possible.

The process and apparatus of the present invention makes it possible to convey the hot sponge-iron particles directly and continuously from the blast-furnace shaft 2 into the smelter-gasifier 1, without it being necessary to use locks or other costly arrangements for sealing the interior of the blast-furnace shaft 2 from the hot reduction gas. Due to the high temperature of the raw reduction gas, and to the nature of the granular sponge-iron being conveyed, it is a difficult matter to obtain this sealing with the necessary operational reliability.

Figure 2:
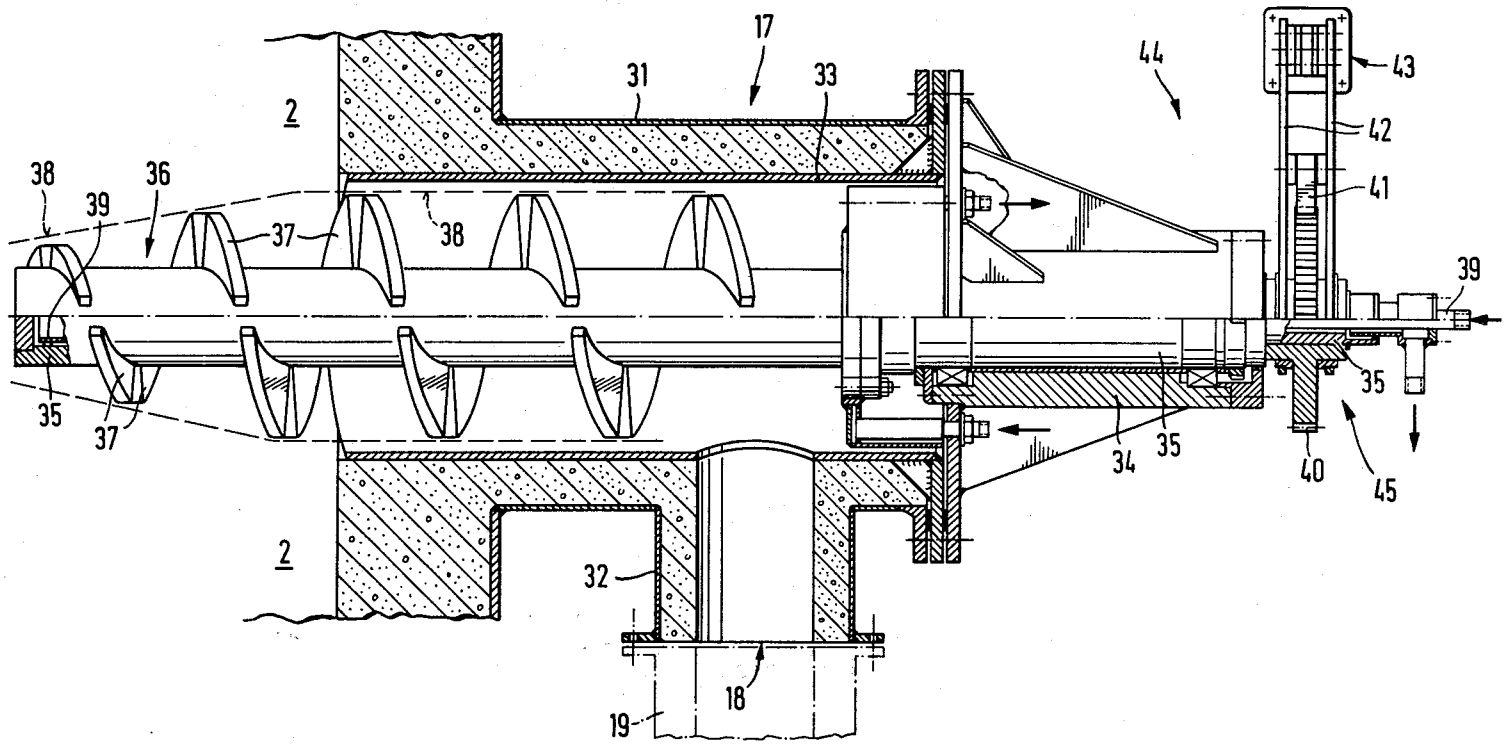
FIG. 2 is a longitudinal section of a paddle-worm conveyor for removing hot sponge-iron particles from the blast-furnace shaft.

FIG. 2 is a partly sectioned side-view of one of the six paddle-worm conveyors 17. The conveyor 17 is shown flange-connected to a connector 31 welded onto the jacket of the blast-furnace shaft 2. Branching off downwards from the connector 31 there is an outlet connector 18 for flange-connecting a fall-pipe 19, as represented in FIG. 1. The refractory lining of the connector 31 is protected from abrasion by a protective sleeve 33, which is also flange-connected to the connector 31.

The nose-portion of the paddle-worm projects far forwards into the interior of the blast-furnace shaft 2. At the other end the paddle-worm conveyor 17 has a drive-bracket 44 flange-connected to the connector 31. The drive-bracket 44 houses and supports a bearing 34.

The worm itself is interrupted at several places so as to form a series of individual paddles 37. The nose-portion of the worm, which projects far forwards into the interior of the blast-furnace shaft 2, is tapered as indicated in broken lines at 38, i.e. its imaginary envelope 38 is conical, becoming narrower towards its outer end. The nose-portion extends forwards, tapered all the way, to near the middle of the blast-furnace shaft 2, the arrangement ensuring an even removal of the sponge-iron material.

The shaft 35 of the worm is hollow and water-cooled. A central inner tube 39, which stops just short of the outer end of the shaft 35, conveys a stream of cooling water which returns through the gap between the inner tube 39 and the inner surface of the hollow shaft 35.

The shaft 35 is driven in rotation by an intermittent drive 45 involving a ratchet wheel 40 and a pawl 41. The pawl 41 is mounted to swing on a lever 42, which itself swings on the shaft 35. A hydraulic or pneumatic piston 43 drives the mechanism, rocking the lever 42 back and forth so that the pawl drives the ratchet wheel 40, which is fixed to the shaft 35, intermittently, one tooth at a time, or several teeth at a time.

If the blast-furnace shaft is of large diameter, it can be necessary to use a worm-conveyor shaft which passes all the way across the blast-furnace shaftm rotating in bearings at both sides of the blast-furnace shaft. In this case the worm blades form helices in opposite directions, i.e. one left-hand helix and one right-hand helix, to ensure that the sponge-iron materials conveyed away in two directions outwards away from the middle of the blast-furnace shaft.

We claim:

1. Process for directly making liquid pig-iron from coarse iron ore, in which the ore is charged as loose bulk material into a direct-reduction shaft and there reduced to sponge-iron by the action of a hot reducing gas, after which the hot sponge-iron is transferred by a discharging device directly through at least one communicating passage into a smelter-gasifier which produces, from coal and a blown-in oxygen-bearing gas, both the heat necessary for melting the sponge-iron and the reduction gas, of which a first part-stream, after cooling to the temperature specified for the reduction of the ore, and after removal of dust, is blown into the reduction zone of the reduction shaft, characterized in that a second part-stream (24) of reduction gas flowing counter-current to the sponge-iron particles is cooled down to a temperature below 950° C. and passed through said communicating passage (19) from the smelter-gasifier to the direct reduction shaft (2), the flow-resistance in the path of the second part-stream being adjusted such that the volumetric flow-rate of the second part-stream (24) is 5 to 30 percent of the total flow of reduction gas entering the direct reduction shaft (2).

2. Process as claimed in claim 1, characterised in that the volumetric flow-rate of the second part-stream (24) is 5 to 15 percent of the total flow of reduction gas entering the direct reduction shaft (2).

3. Process as claimed in claim 2, characterised in that the volumetric flow-rate of the second part-stream (24) is 8 to 10 percent of the total flow of reduction gas entering the direct reduction shaft (2).

4. Process as claimed in claim 1, characterised in that the second part-stream (24) is cooled down to 750° to 850° C. in the communicating passage (19).

5. Process as claimed in claim 1, characterised in that the second part-stream (24) is cooled in the communicating passage (19) by admixing a third part-stream (23) of the reduction gas produced in the smelter-gasifier (1), after this part-stream has been cleaned and adequately cooled.

6. Process as claimed in claim 5, characterised in that the gas in the third part-stream (23) is cooled down to 50° C. before it is mixed with the second part-stream (24).

7. Process as claimed in claim 5, characterised in that the flow-resistance in the path of the first part-stream (13) between the smelter-gasifier (1) and the inlet (4) of the reduction zone of the direct reduction shaft is much less than the flow-resistance in the paths of the second and third part-streams (24, 23) between the smelter-gasifier and the inlet of the reduction zone.

* * * * *